US008214044B2

(12) United States Patent
Dal Molin

(10) Patent No.: US 8,214,044 B2
(45) Date of Patent: Jul. 3, 2012

(54) TELEMETRY APPARATUS FOR COMMUNICATIONS WITH AN ACTIVE DEVICE IMPLANTED IN A PATIENT'S THORACIC REGION

(75) Inventor: Renzo Dal Molin, Chatillon (FR)

(73) Assignee: Sorin CRM S.A.S., Clamart (FR)

( * ) Notice: Subject to any disclaimer, the term of this patent is extended or adjusted under 35 U.S.C. 154(b) by 723 days.

(21) Appl. No.: 11/469,676

(22) Filed: Sep. 1, 2006

(65) Prior Publication Data

US 2007/0123948 A1 May 31, 2007

(30) Foreign Application Priority Data

Sep. 1, 2005 (FR) ..... 05 08944

(51) Int. Cl.
*A61N 1/00* (2006.01)
*A61B 5/04* (2006.01)

(52) U.S. Cl. ..... 607/32; 607/46; 600/388

(58) Field of Classification Search ..... 607/32, 607/46; 600/388
See application file for complete search history.

(56) References Cited

U.S. PATENT DOCUMENTS

| | | | | |
|---|---|---|---|---|
| 5,117,825 | A * | 6/1992 | Grevious | 607/32 |
| 5,562,714 | A * | 10/1996 | Grevious | 607/32 |
| 5,611,085 | A | 3/1997 | Rasmussen et al. | |
| 5,792,205 | A * | 8/1998 | Alt et al. | 607/32 |
| 6,032,289 | A * | 3/2000 | Villapiano | 2/102 |
| 6,483,469 | B2 | 11/2002 | Boyle | |
| 6,590,540 | B1 | 7/2003 | Adams et al. | |
| 6,680,707 | B2 | 1/2004 | Allen et al. | |
| 6,681,404 | B1 * | 1/2004 | Adlard et al. | 2/94 |
| 7,062,330 | B1 * | 6/2006 | Boveja et al. | 607/41 |
| 2003/0187341 | A1 * | 10/2003 | Sackner et al. | 600/388 |
| 2003/0212319 | A1 * | 11/2003 | Magill | 600/382 |
| 2003/0212440 | A1 * | 11/2003 | Boveja | 607/46 |
| 2004/0009731 | A1 | 1/2004 | Rabinowicz | |
| 2005/0010096 | A1 * | 1/2005 | Blackadar | 600/388 |
| 2005/0010268 | A1 | 1/2005 | Wanderstok | |
| 2005/0054941 | A1 * | 3/2005 | Ting et al. | 600/529 |
| 2005/0059896 | A1 | 3/2005 | Drakulic | |

FOREIGN PATENT DOCUMENTS

| | | | |
|---|---|---|---|
| EP | 551708 | A1 * | 7/1993 |
| EP | 1481708 | | 12/2004 |
| WO | WO 01/45038 | A2 | 6/2001 |

* cited by examiner

*Primary Examiner* — Nicole F LaVert
(74) *Attorney, Agent, or Firm* — Orrick Herrington & Sutcliffe, LLP

(57) ABSTRACT

Apparatus for telemetry equipment for communication with an active device implanted in the thoracic area of a patient This equipment includes a wave collector (16) essentially sensitive to a magnetic field so as to allow an exchange of signals through magnetic coupling (i.e., an inductive channel) with the implanted device (14). The wave collector is connected to an electronic circuit package (24) for transmission/reception and signal processing of acquired data and programming. The apparatus further comprises a cloth (10) in the form of a vest to be worn by and able to cover at least one part of the patient's anatomy, a support structure (18) for receiving and supporting the wave collector, and adjustable members able to fix the support structure at a chosen location of the cloth, for example, by means of hooking tapes (20) disposed on the support (18) and cooperating surface material on the cloth. Thus, after initial positioning of the wave collector in front of the area where the device is implanted, placement and maintaining of the wave collector will be fixed to that location each time the patient puts the cloth on.

16 Claims, 1 Drawing Sheet

TELEMETRY APPARATUS FOR COMMUNICATIONS WITH AN ACTIVE DEVICE IMPLANTED IN A PATIENT'S THORACIC REGION

FIELD OF THE INVENTION

The present invention relates to "active implantable medical devices" as such devices are defined by the Jun. 20, 1990 Directive 90/385/CEE of the Counsel of the European Community. This definition includes cardiac pacemakers, defibrillators, cardioverters and/or multisite devices, but also devices such as neurological stimulation devices, drug diffusion pumps, cochlear implants, implanted biological sensors, etc., as well as devices for pH measurement or intracorporeal impedance measurement (such as transpulmonar impedance or intracardiac impedance).

BACKGROUND OF THE INVENTION

Active implantable medical devices can be placed in a particular configuration so as to ensure data exchange with an external apparatus (often called a "programmer"), allowing to verify parameterization of the implanted device, read the data recorded thereby, notably the data of the "Holter" type intended to an a posteriori statistical analysis of cardiac activity over a long duration, or to write (i.e., record) some data into the device's memory, notably to reprogram or update the implanted device software and/or firmware.

The present invention is more particularly directed to the circumstances when the data exchange between said implanted device and external apparatus is operated by means of varying the magnetic field produced by an induction coil, a technique that is known by a person of ordinary skill in the art as an "induction process". The electromagnetic coupling between the implanted device and the external apparatus is therefore essentially a magnetic coupling, with the implanted device and the external apparatus having therefore so-called "wave collectors" in the form of similar coils that shall be positioned facing one another so as to ensure proper magnetic wave coupling.

Coupling of the external apparatus with the implanted device is usually performed by the practitioner who is operating the external apparatus, who uses a device called a "programming head" or "telemetry head" in the form of a housing containing the coil of the external apparatus (programmer), as well as associated electronic circuits. The telemetry head is connected to the external programmer by means of a cable. The practitioner has to move the telemetry head above the patient's body in the region where the implanted device has been implanted, until the position leading to the highest (or at least a minimum acceptable) signal level is located: that means that the telemetry head is positioned right in front of the implanted device, which ensures optimal coupling. Then the practitioner can go forward and proceed to initiate the data exchange between the implanted device and the programmer, while maintaining the telemetry head at the position thus determined.

The search for optimal coupling is a determining factor, not only toward the quality and reliability of the exchange of signals between the implanted device and the external apparatus, but also in order to reduce the current consumption of the emitting circuits of the implanted device, therefore increase the longevity of the latter: indeed, an imperfect coupling requires a higher transmission power, and therefore induces a higher energy consumption of the implant.

The operating mode described above is typically practiced by all practitioners during a patient office visit to a practitioner following implantation of the device.

It can however be desirable, notably thanks to the new communication media (Internet, GPRS, UMTS, . . . ) to ensure a remote follow-up of the patient and home-monitoring, without any intervention by the practitioner. More advantageously, it can also be desirable to perform this follow-up at regular time intervals, for example, with a daily data recovery and teletransmission towards a remote telesurveillance server, so as to ensure a much closer or more frequent surveillance of the patient's health status, while avoiding multiple office visits with the practitioner.

The practitioner being not present, the implementation of the external device implies the patient's direct involvement to effect the data exchange.

One problem with this is the necessity to properly position the wave collector of the external device relatively to the implanted device, so as to ensure optimal coupling between these two elements of the telemetry system. It is not desirable that the patient himself searches for the optimal positioning whenever the implanted device needs to be interrogated: In addition to the time wasting in attempts and the difficulty for an inexperienced person to find the optimal coupling, the patient may present a loss of autonomy that could not allow him to perform this operation.

It also should be understood that the search for optimal coupling of the wave collector is a relatively tedious operation for an inexperienced person: the wave collector of the external device is an antenna with a diameter around 5 cm, that shall be centered in front of the implanted device, which has a wave collector having a diameter around 2 cm, and that shall be done with an accuracy of about 1 cm so as to ensure a satisfactory optimal coupling.

Furthermore, this precise positioning must be maintained throughout the complete duration of the operation (interrogating an implanted device can last several minutes), with a lack of coupling inducing a risk to lead to a loss of information obliging one to repeat or start over again some interrogation sequences.

Some clothes comprising built in antennae are already known in the prior art: see for reference, patents U.S. Pat. Nos. 6,590,540, 6,483,469 or 6,680,707. However, these patents disclose radiofrequency antennae for communication with a different type of equipment, for example, a radio transmitter or a radiocommunication base station. Also, these disclosures do not concern with a telemetry process implementing an induction process, and do not recognize that there is a need for the precise positioning of the antenna onto the patient's body, and positioning of the antenna is not a determining parameter. These documents therefore do not address the problem that is specific to the present invention, which is correlated to the very close proximity between the respective wave collectors of the implanted device and the external apparatus.

OBJECTS AND SUMMARY OF THE INVENTION

It is therefore an object of the present invention to overcome the problem of patient effected coupling by a telemetry apparatus intended to communicate with an active device implanted in the thoracic area of a patient, comprising a wave collector essentially sensitive to a magnetic field, so as to allow the exchange of signals through an inductive channel with an implanted device, and means for linking the wave collector to an electronic circuit package for the transmission/reception and signal processing.

In a manner characteristic of the present invention, the telemetry apparatus comprises a cloth (i.e., an article of clothing) preferably in the form of a vest, able to cover at least part of the patient's anatomy, a support structure for receiving and supporting the wave collector, and adjustable means for fixation of the support structure at a determined or chosen location on the cloth.

The cloth thus allows, after an initial positioning of the wave collector in front of the area where the implanted device is implanted, to place and maintain this wave collector in a position to effect a suitable magnetic coupling, whenever the patient puts the cloth on.

In such a manner, the practitioner positions essentially once and for all the telemetry wave collector onto the cloth, by searching the optimal position, and fixing the wave collector support structure at a location on the structure with the wave collector at the optimal position. Then, the patient will not have to wonder about starting over again this operation every time, and will have a minimum of movements to make, the optimal position having been already determined and adjusted. In this regard, it should be understood that the cloth is adjusted so as to be custom fit for and specific to each patient, as is the adjustment of the support structure to effect the wave collector position.

The adjustable means for fixation of the support can notably comprise hooking tapes or bands disposed on the support and cooperating with a complementary material on the surface of the cloth, or conversely hooking bands disposed on the cloth and cooperating with the material on the surface of the support. (E.g., belt buckles or snap fastners or Velcro brand or compatible hooks and loops interlocking straps.)

In accordance with some preferred embodiments, and various subsidiary advantageous characteristics of the present invention, the cloth optionally comprises:

- Means for supporting and embedding the electronic circuit package for transmission/reception and signal processing;
- Means for adapting to the patient's morphology (anatomy), so as to allow, after adaptation, adjusted wearing of the cloth, for instance elastic areas and/or means for dimensional adjustment of the cloth;
- Means for embedding at least one sensor of physiologic or therapeutic data, as well as means for connecting said sensor(s) to the electronic circuit package for transmission/reception and signal processing;
- A peaking coil associated with the wave collector, that can be placed at a given predetermined location on the cloth;
- At least one shielding surface against an electrical noise field, that shielding surface being made of an electrically conductive non-magnetic material essentially transparent to the magnetic field in the range of frequencies used for said exchange of signal through the inductive channel.

The term "embedding" should be understood to include placing the electronic package or sensor in a pouch or pocket in the cloth with a closure such as a zipper, or otherwise fastening it to the cloth as by stitching, snap mechanisms, clips or hook and loop tapes, to obtain a detachable or permanent connection as desired.

BRIEF DESCRIPTION OF THE DRAWINGS

Further features, characteristics and advantages of the present invention will become apparent to a person of ordinary skill in the art from the following detailed description of a preferred embodiment of a device of the present invention, made with reference to the annexed figures, on which the same reference numbers represent identical or functionally similar elements, and in which.

DETAILED DESCRIPTION OF THE INVENTION

Figure 1:
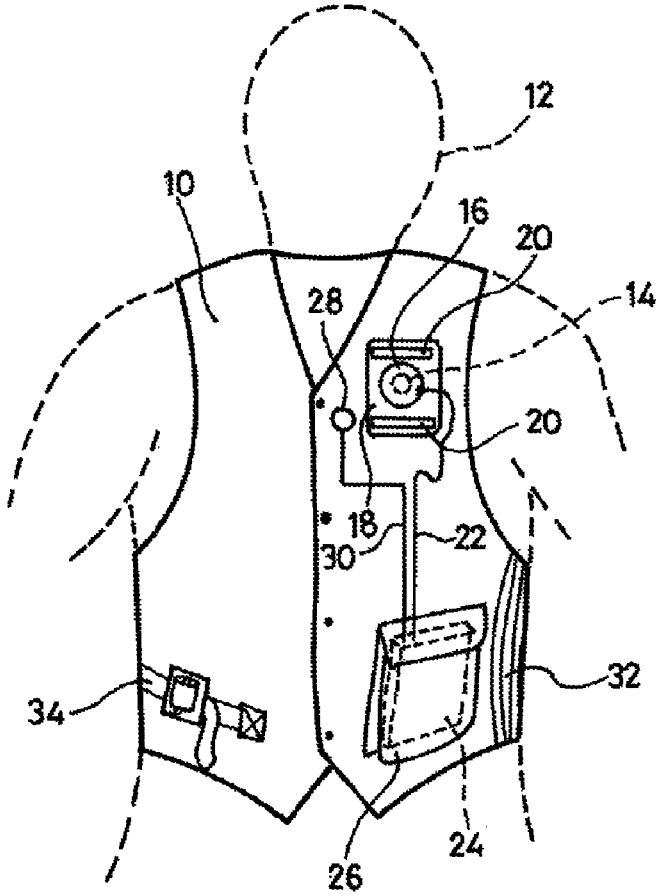
FIG. 1 shows the telemetry equipment of the invention, with the cloth equipped with its various associated elements.

With reference to the drawings, reference number 10 designates a cloth, for example, in the form of a vest, to be worn by the patient 12. The shape or style of the vest is however non restrictive, and it should be understood that other shapes of clothes or clothing accessories may be used, such as a jumper, a harness, a chest harness, etc., insofar as that cloth is easy to put on by the patient and provides an accurate and durable positioning of the wave collector from wearing to wearing.

The patient is implanted with an active device 14, for example, a cardiac pacemaker or defibrillator, the case of which has been placed in a body region whose position may vary as a function of the surgeon and implantation constraints, and indeed may be placed on the left side as well as right side of the patient, as the case may be.

So as to allow the interrogation of implanted device 14, an external apparatus comprises a wave collector 16 in the form of a coil, preferably one that is flat and circular, made either as part of a printed circuit or through wire technology.

In the present embodiment, the coil is fixed to a support structure 18, for instance a piece of woven fabric with a dimension slightly greater than that of the wave collector 16 and provided with means for fixation to cloth 10, for example, with hooking tapes 20 that engage securely with cloth 10 and allow to firmly maintain the support structure 18 on a given location once the optimal coupling position has been determined. These hooking tapes 20 are comprising, for example, a plurality of hooks likely to hook up to the surface of the textile constituting the cloth 10, i.e., cooperating, e.g., a plurality of loops, (i.e., interlocking hooks and loops disposed in opposition projecting from strips of backing material).

This mode of fixation allows to adjust in a very fine manner, the position of wave collector 16 superimposed relative to the implanted device, with an accuracy that is within around 1 cm. The reduced or small movements of the patient wearing cloth 10 do not disturb the system operation.

The support 18 structure may be placed inside or outside the cloth 10. A wire 22 links the wave collector 16 to an electronic circuit package 24 comprising the circuits for transmission/reception (including a tuning capacitor of a resonant circuit associated with coil 16) and processing of transmitted and received signals. More advantageously, cloth 10 also comprises means for supporting package 24, for example, an internal or external pocket 26, or any other appropriate means (webbing, straps, snaps, clips, etc.). It should be understood that the technical details as to the operation and functionality of electronic circuit package 24 will not be discussed in detail because they form no part of the present invention, which concerns only the physicality of package 24 and its connection to wave collector 16 and a communications network.

The telemetry equipment may also comprise an additional coil 28, referred to as "peaking coil", associated with wave collector 16 and linked to the electronic circuit package 24 through a specific connecting wire 30. The function of peaking coil 28 is to sense the noise components coming from external sources of disturbance in order to subtract such noise components from the signal sensed by wave collector 16 when 15 extracting the desired signal, thus improving the signal/noise ratio (one can refer to published patent application EP-A-1,481,708 and its U.S. counterpart published application US 2005/0010268, now issued as U.S. Pat. No. 7,096,069 on Aug. 2, 2006, commonly assigned herewith to ELA Medical for more details on such peaking coils, which reference is incorporated herein by reference in its entirety). The position of peaking coil 28 relative to the implanted device 14 is far less critical than that of the wave collector 16, and therefore the peaking coil cab be embedded within the cloth at a fixed location, preferably at an approximatively central location, so that the practitioner and the user shall not care about that peaking coil 28 or its position.

A precise positioning, with a good repeatability, of wave collector 16 requires that cloth 10 be properly worn, well-adjusted and with the wave collector held close to the body. To this end, various means for adjusting cloth 10 to the patient's morphology (anatomy) can be foreseen, for example, elastic fabric areas 32 and/or a system of webbing and buckles 34, string ties or by any other adjustment mechanism allowing to prevent the cloth from being worn too loosely that would prevent proper positioning of wave collector 16 relative to the implanted device.

Thus, the setting of wave collector position can be retrieved without any difficulties whenever the cloth is to be put on.

The material of the cloth is chosen so that the latter can be worn over a long period of time, without inducing any annoyance towards the patient's respiration, nor towards his thermal comfort. The cloth is preferably washable, upon removal of the electronic circuit package 24, which likely does not withstand immersion. The wave collector 16 and the peaking coil 28, as well as their connecting means, may be made so as to be immersion-proof, which prevents from having to remove them for washing, and allows to keep the initial positioning without preventing from washing the cloth.

It also has been recognized by the inventors that, in addition to disturbances of a magnetic nature (stray inductions) that can be efficiently minimized, if not eliminated, by use of peaking coil 28, the signal/noise ratio may be affected by some components that are essentially of an electrical nature, notably transmitted through a capacitive channel. The wave collector that is used, which is essentially sensitive to magnetic fields, is also sensitive to electrical fields, though at a lower level, which as a consequence may significantly alter the signal/noise ratio under certain situations.

In order to alleviate that phenomenum, it is optionally possible to foresee also shielding surface areas on cloth 10 against stray electrical fields. This can be achieved, for example, by employing surfaces made of a non-magnetic conductive material, essentially transparent to the desired magnetic field in the range of frequencies conventionally or otherwise to be used for telemetry (typically a few tens of kilohertz) over the inductive channel and essentially opaque against electrical fields in the range of frequencies within which the strays electrical fields are likely to disturb the programmer operation (typically from a few kilohertz to a few Megahertz). That non-magnetic conductive material can be a metallic non ferrous material, for example, Zinc, copper or silver/copper, either made up in the form of a follower element, or by incorporating wires made of this material into the woven fabric of the textile constituting cloth 10. Carbon may also be used to make this shielding, for it is a material that is both a very good conductor, and totally transparent to the relevant magnetic fields.

Figure 2:
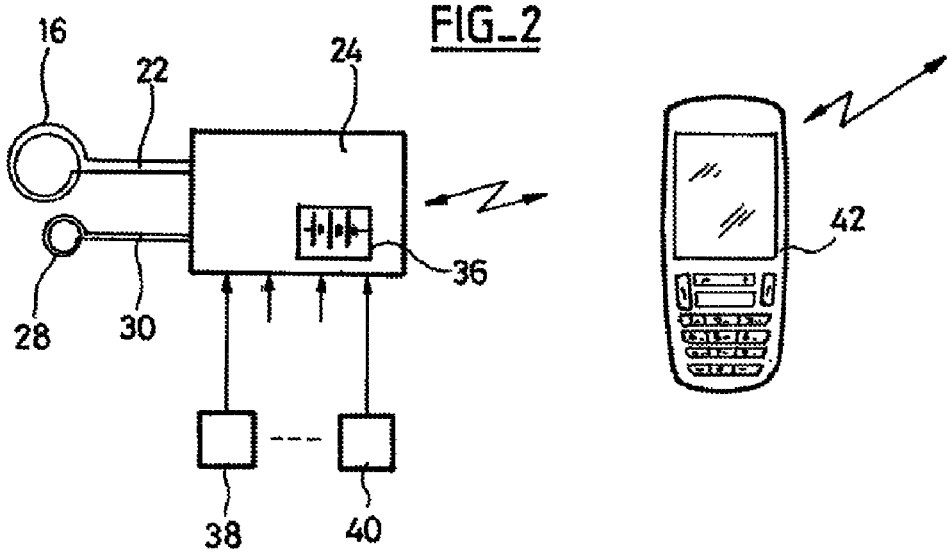
FIG. 2 is a block schematic diagram showing the different electronic circuit elements implemented by the equipment of FIG. 1.

As illustrated on FIG. 2, the electronic package 24 includes its own electrical supply 36, and also allows connecting to sensors 38, 40, . . . likely to provide to the electronics package certain types of information or measurements: sphygmomanometer, ECG device, personal scale, means of compliance such as an "electronic medication organizer", etc. These sensors 38, 40, . . . can be connected to the electronic package 24 through wires, or advantageously through a wireless link such as Bluetooth (registered trademark of Bluetooth SIG). In the particular case where the sensors are ECG sensors, the intervention of a qualified personnel is required so as to fit the electrodes and implement the specific ECG acquisition package; the data processed by this ECG package are, once again, advantageously transmitted to the electronic package 24 through wireless link.

The telemetry data collected by the package 24 are transmitted, as well as other data eventually collected by the sensors 38, 40, . . . , to a means for data communication, which can advantageously be a mobile phone 42 connected to the package 24 through a wire, or more advantageously, through a wireless link such as Bluetooth. The data can then be exchanged between a remote site and the electronics package 24, therefore between the site and the implanted device via the wave collector 16, by any appropriate means for data transmission known, such as GSM, GPRS, UMTS, . . . .

The operating procedure of this cloth, equipped with its different accessories, is as follows:

On demand from a physician or a medical staff member, or spontaneously at a determined time or otherwise, the patient puts on cloth 10 optionally equipped with one or more of its accessories, possibly autonomously or with some external help, according to the patient's level of autonomy.

The patient then triggers an uploading of data by switching on the electronic circuit package 24, which establishes communication with the remote site through the mobile phone 42. The end of transmission may be signaled to the patient, e.g., an audible annunciator or piezo electric vibration, by the package and/or electronic modules that automatically switch off when a preprogrammed duration expires. The patient can then remove cloth 10.

That operation can be performed daily; it requires a typical communication duration of around 5 minutes for the transmission of 3 kB of data through GPRS over a mobile phone connection. One can note that this operation, thanks to GSM/GPRS transmission, is independent from the patient's location, who may be at home as well as outside. The operation can of course be performed at more spaced apart time intervals, as a function of the data to be monitored and/or clinical status of the patient.

In the case when electronics package 24 is connected to sensors such as 38, 40, . . . the data are collected by electronics package 24, for example, through short-range radio link such as Bluetooth. Between two sessions of connection to the remote site, the electronics package 24 records and stores these data. During that phase, the patient may not wear cloth 10, or not have switched on the electronic package 24, which however always remains in standby mode, in the waiting for a communication emanating from a sensor. When the package is activated by the patient, the latter triggers on the transmission towards the remote site, via the mobile phone 42, of the data that had been stored in memory. Upon reception of an acknowledgement from the remote site, these data are preferably deleted from the memory of electronics package 24.

Alternative technologies to a wireless Bluetooth enabled mobile phone may be used for communications with a remote site, e.g., a wire based or wireless connection to an internet connected computer, wireless messaging device, or PDA.

One skilled in the art will appreciate that the foregoing invention may be practiced by other than the embodiments described, which are disclosed for purposes of illustration and not of limitation.

I claim:

1. Apparatus for telemetry communication with an active device implanted in a thoracic area of a patient, the active device including one of a pacemaker, a resynchronization, a defibrillation, a cardioversion device, and a diagnostic device, said apparatus being external to the implanted active device and comprising:

a cloth in the form of a vest covering at least one part of the patient's anatomy and having a frontal outer surface;

a wave collector transmitting and receiving signals to and from said implanted device through an inductive channel;

a first wire connecting said wave collector to an electronic circuit package for transmission, reception and processing of the signals;

a peaking coil associated with the wave collector, the peaking coil being embedded within the cloth and sensing noise components;

a second wire connecting said peaking coil to the electrical circuit for transmission of the noise components;

a support structure receivably supporting the wave collector; and adjustable means for fixing said support structure at a chosen location on the frontal outer surface of said cloth, said support structure when fixed at said chosen location placing the wave collector within a magnetic coupling region between said wave collector and said implanted device, wherein, after an initial placement of said support structure on the frontal outer surface of said cloth, at said chosen location, the wave collector is placed repeatedly within the magnetic coupling region every time the patient wears the cloth, and wherein the electrical circuit subtracts the noise components from the signals.

2. The apparatus of claim 1, where said adjustable means further comprises at least one hooking tape disposed on the support structure, and wherein the at least one hooking tape cooperates with a material surface of the cloth to fix said support structure at said chosen location.

3. The apparatus of claim 1, wherein the cloth further comprises means for supporting and embedding said electronic circuit package.

4. The apparatus of claim 1, wherein the cloth further comprises means for fine adjustment adapting the cloth to fit to the patient's anatomy after the patient wears the cloth.

5. The apparatus of claim 4, wherein said means for fine adjustment further comprises at least one elastic material area integral with the cloth.

6. The apparatus of claim 4, wherein said means for fine adjustment further comprises means for adjusting a dimension of the cloth.

7. The apparatus of claim 1, wherein the electronic circuit package is receivably linked to at least one sensor of a physiologic or therapeutic data.

8. The apparatus of claim 1, wherein said peaking coil is disposed at a predetermined location on the frontal outer surface of the cloth.

9. Apparatus for telemetry communication with an active device implanted in a thoracic area of a patient, the active device including one of a pacemaker, a resynchronization, defibrillation, a cardioversion device, and a diagnostic device, said apparatus being external to the implanted active device and comprising:

a cloth in the form of a vest covering at least one part of the patient's anatomy and having a frontal outer surface;

a wave collector transmitting and receiving signals to and from said implanted device through an inductive channel;

a first wire connecting said wave collector to an electronic circuit package for transmission, reception and processing of the signals;

a peaking coil associated with the wave collector, the peaking coil being embedded within the cloth and sensing noise components;

a second wire connecting said peaking coil to the electrical circuit for transmission of the noise components;

a support structure receivably supporting the wave collector; and adjustable means for fixing said support structure at a chosen location on the frontal outer surface of said cloth, said support structure when fixed at said chosen location placing the wave collector within a magnetic coupling region between said wave collector and said implanted device, wherein, after an initial placement of said support structure on the frontal outer surface of said cloth, at said chosen location, the wave collector is placed repeatedly within the magnetic coupling region every time the patient wears the cloth, wherein the electrical circuit subtracts the noise components from the signals, and wherein the cloth further comprises at least one surface shielding against stray electrical fields, said shielding surface being made of a non-magnetic conductive material essentially transparent to magnetic fields within the magnetic coupling region in a range of frequencies used for exchanging said signals through said inductive channel.

10. The apparatus of claim 9, where said adjustable means further comprises at least one hooking tape disposed on the support structure, and wherein the at least one hooking tape cooperates with a material surface of the cloth to fix said support structure at said chosen location.

11. The apparatus of claim 9, wherein the cloth further comprises means for supporting and embedding said electronic circuit package.

12. The apparatus of claim 9, wherein the cloth further comprises means for fine adjustment adapting the cloth to fit to the patient's anatomy after the patient wears the cloth.

13. The apparatus of claim 12, wherein said means for fine adjustment further comprises at least one elastic material area integral with the cloth.

14. The apparatus of claim 12, wherein said means for fine adjustment further comprises means for adjusting a dimension of the cloth.

15. The apparatus of claim 9, wherein the electronic circuit package is receivably linked to at least one sensor of a physiologic or therapeutic data.

16. The apparatus of claim 9, wherein said peaking coil is disposed at a predetermined location on the frontal outer surface of the cloth.

* * * * *